United States Patent [19]

Sheffer

[11] Patent Number: 4,676,383

[45] Date of Patent: Jun. 30, 1987

[54] SHELF OR PANEL UNIT

[75] Inventor: Phil B. Sheffer, New Oxford, Pa.

[73] Assignee: Merchandising Innovations Co., Hanover, Pa.

[21] Appl. No.: 821,842

[22] Filed: Jan. 23, 1986

[51] Int. Cl.[4] ..... A47F 5/00

[52] U.S. Cl. ..... 211/135; 211/149; 211/195; 108/111

[58] Field of Search ..... 211/153, 135, 194, 195, 211/85, 104, 132, 149; 312/107, 108, 259–260, 261, 258; 229/41 R, 23 R, DIG. 4; 52/36; 248/174; 108/111; 428/167

[56] References Cited

U.S. PATENT DOCUMENTS

| | | | |
|---|---|---|---|
| 3,952,672 | 4/1976 | Gordon et al. | 248/174 X |
| 4,519,319 | 5/1985 | Howlett | 248/174 X |
| 4,582,003 | 4/1986 | Valero | 211/195 X |

FOREIGN PATENT DOCUMENTS

| | | | |
|---|---|---|---|
| 3341335 | 5/1985 | Fed. Rep. of Germany | 312/259 |

*Primary Examiner*—Carl D. Friedman
*Assistant Examiner*—Naoko N. Slack
*Attorney, Agent, or Firm*—Daniel J. O'Connor

[57] ABSTRACT

A method and apparatus for constructing a light weight yet durable shelf or panel unit. The preferred material of the invention is corrugated fiberboard. It will be appreciated, however, that the inventive concepts may will be applied to other materials such as plastic compounds and derivatives.

In use of the design, light weight materials are folded together to yield a durable shelving structure with fastening means being formed on side edges thereof. The basic panel is designed as a one-piece unit with two rectangular pieces inserted therein in use of the invention.

1 Claim, 1 Drawing Figure

SHELF OR PANEL UNIT

Figure 1:
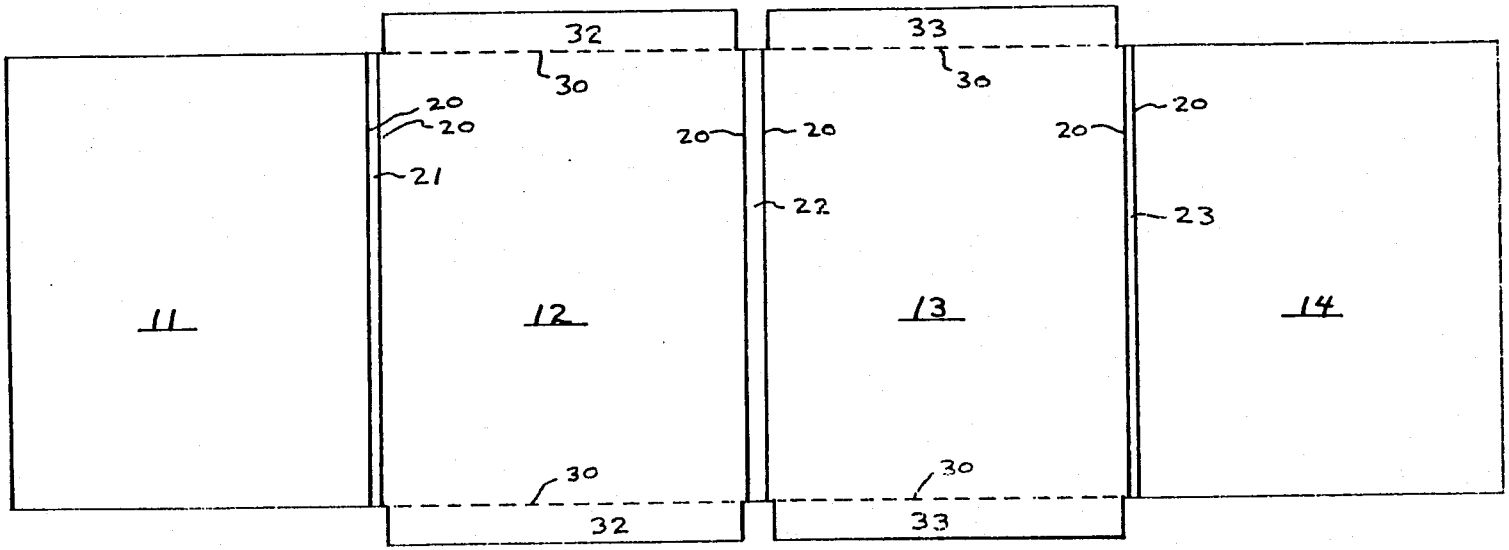

Papers relating to the present invention were previously filed under the Disclosure Document Program of the U.S. Patent Office.

BACKGROUND OF THE INVENTION

The invention relates generally to a novel method of constructing a shelf or panel unit by means of a factory pre-formed and pre-cut apparatus.

It has been known in the prior art to construct various furniture articles of light weight paperboard or other related materials. One problem encountered with such uses in that they typically require complex assembly techniques thus discouraging widespread consumer uses of such articles.

A further problem encountered in that the end product paperboard design is not durable in appearance or function.

The related prior art patented systems are listed as follows: U.S. Pat. 3,429,632 issued to Simon; U.S. Pat. 3,628,842 issued to Wright; U.S. Pat. 4,124,260 issued to Bergman.

The patents issued to Simon and Bergman illustrate paperboard structures requiring overly complex assembly procedures by the user thereof. The Simon patented device, while easier to assemble than other prior art systems, lacks the durability of the present invention and has the further problem of extended internal flap elements which may interfere with the intended drawer operation.

OBJECTS OF THE INVENTION

Accordingly, it is an object of the present invention to provide a universal shelf or panel unit which, although capable of shipment in a flat or knockdown position, may be readily assembled by the purchaser thereof.

It is a further object to provide a shelving unit which is constructed of lightweight materials such as corrugated fiberboard and which has both a durable appearance and a highly sturdy functional aspect in use.

It is a further object to provide a novel shelving assembly unit having bendable fastener means formed as an integral part thereof to provide ease of assembly and a highly stable end product for the consumer.

BRIEF SUMMARY OF THE INVENTION

The shelving unit is made entirely of corrugated fiberboard materials. Two smaller folding zones are formed laterally on the unit and a larger folding zone is formed at a midline of the unfolded shelf by way of score lines which are factory applied to the corrugated fiberboard.

The factory formed score lines also define four main panel sections or zones on the device which are sized so that the unit may be simply folded together without the use of fasteners or time consuming assembly techniques.

Of the four main panel sections formed, two central panels have flaps formed at the edges thereof by means of factory cut perforated score lines. The perforated score lines thus allow the flaps to be folded outwardly from the folded panel and thus be used as fastener means in cooperation with, for example, preformed bookshelf slots or channels.

BRIEF DESCRIPTION OF THE DRAWING FIGURE

The single drawing FIG. 1 shows an elevational view of the shelving unit in its flattened or knockdown position.

FULL DESCRIPTION OF THE PREFERRED EMBODIMENT

Referring to the single drawing figure, there is shown a one-piece flattened single wall corrugated fiberboard layer.

The piece shown has four main sections or zones 11, 12, 13 and 14 formed therein via score lines 20. It is to be understood that all score lines and cuts described herein are pre-done in the factory so as to reduce the labor involved in assembling the device.

As shown, the score lines 20 form folding zones 21, 22 and 23.

The central sections 12 and 13 have extended flap portions 32 and 33 respectively formed at the outer edges thereof. Flaps 32 and 33 are bendable by way of perforated score lines 30.

It is to be understood that two rectangular panels made of double wall corrugated fiberboard are also used with the invention. Said two panels are sized so as to be equal in area to central sections 12 and 13.

In assembly of the shelf, the two double wall corrugated panels are placed squarely on central sections 12 and 13 respectively. Next, sections 11 and 14 are folded inwardly over said panels. Then, the unit is folded inwardly via the larger central fold section 22.

Finally, flaps 32 and 33 are folded outwardly via perforated score lines 30.

It will thus be appreciated that the resulting construction forms a thick and durable shelf or panel, but which has been formed entirely of light weight materials and is very easy to assemble.

It is intended that flaps 32 and 33 would be simply slid into preformed vertical walls also made of corrugated fiberboard. For example, such a panel construction could be used as bookshelves, as desk panel portions, etc. Related patent applications describing such uses have been filed by applicant.

Such a durable overall panel construction could also be utilized on a larger scale as room dividers or other structural systems.

It is important to realize that the unit is light weight to reduce shipping costs and may be shipped in a flat position to reduce shipping volume requirements.

It is further quite simply assembled to reduce labor costs and has its own fastener means (flaps 32 and 33) pre-incorporated therein so that such fastener costs and assembly problems are avoided.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. A foldable shelving unit of corrugated fiberboard, said shelving unit comprising:

an elongated rectangular element having two lateral folding zones (21, 23) performed thereon by means of score lines (20), said two lateral folding zones (21,23) being of equal width, said elongated rectangualr element further having a central folding zone (22) performed thereon by means of score lines (20), said central folding zone (22) being substanially wider than said two lateral folding zones (21, 23), means wherein said score lines (20) also delineate first (11), second (12), third (13) and fourth main sections of the shelving unit, means wherein said second section (12) and said third section (13) are located interiorly of said first and fourth sections (11, 14) when the shelving unit is in its unfolded position, means (30) wherein bendable flaps are formed on said second and third sections (12,13)

means whereby said flaps (32, 33) may be bent outwardly to act as a fastening element for the overall shelving units, wherein said first, second, third and fourth main sections (11, 12, 13, 14) are of approximately the same area, wherein said flaps (32, 33) are of substanially reduced area as compared to said main sections (11, 12, 13, 14), wherein the means (30) forming bendable flaps (32, 33) comprise perforated score lines which are factory pre-cut in the shelving unit, wherein said score lines (20) which delinate the first, second, third, and fourth sections extend transversely across the entire width of the elongated rectangualr element.

* * * * *